US005228221A

United States Patent [19]

Hillard et al.

[11] Patent Number: 5,228,221

[45] Date of Patent: Jul. 20, 1993

[54] BOOM ASSEMBLY FOR A TRENCHER MACHINE

[75] Inventors: Randy H. Hillard, Wichita; Stephen A. Youngers, Clearwater; Robert G. Draney, Wichita, all of Kans.

[73] Assignee: Case Corporation, Racine, Wis.

[21] Appl. No.: 889,446

[22] Filed: May 27, 1992

[51] Int. Cl.[5] ..... E02F 5/06; E02F 5/14

[52] U.S. Cl. ..... 37/355; 37/464; 37/363; 384/477; 384/488

[58] Field of Search ..... 37/86, 86 A, 86 S, 87, 37/88, 89, 90, 191 R, 191 A, 192 R, 192 A; 384/477, 488, 585, 587, 586, 588; 474/43, 94

[56] References Cited

U.S. PATENT DOCUMENTS

| | | | |
|---|---|---|---|
| 1,684,869 | 9/1928 | Krieger | 37/87 |
| 2,835,055 | 5/1958 | Hermes | 37/86 A |
| 2,866,670 | 12/1958 | Harn's et al. | 384/484 |
| 3,087,354 | 4/1963 | Malzahn | 37/86 A |
| 3,140,129 | 7/1964 | Koss | 384/484 X |
| 3,466,542 | 5/1969 | Whitehurst | 384/477 |
| 4,327,508 | 5/1982 | Youngers | 37/86 |
| 4,483,084 | 11/1984 | Caldwell et al. | 37/DIG. 17 X |
| 4,915,511 | 4/1990 | Kotegawa et al. | 384/586 X |

FOREIGN PATENT DOCUMENTS

| | | | |
|---|---|---|---|
| 2824687 | 12/1979 | Fed. Rep. of Germany | 384/585 |

*Primary Examiner*—David H. Corbin
*Assistant Examiner*—Arlen L. Olsen
*Attorney, Agent, or Firm*—Rudnick & Wolfe

[57] ABSTRACT

A boom assembly including a boom with laterally spaced side walls and adapted to have a digging chain and tooth assembly rotatable thereabout. A boom end idler assembly is arranged between the side walls at the free end of the boom for rotatably supporting the digging chain and tooth assembly. The boom end idler assembly includes a boom end idler rotationally supported by an anti-friction bearing. Axially aligned members pass through aligned apertures in the side walls of the boom and at least partially within the inner race of the bearing for defining the rotational axis of the boom end idler and for clamping the side walls of the boom to each other to minimize clearances between the boom and the boom end idler. Seals are provided to close the clearances proximate the bearing and inhibit foreign debris from contaminating the anti-friction bearing.

12 Claims, 2 Drawing Sheets

BOOM ASSEMBLY FOR A TRENCHER MACHINE

FIELD OF THE INVENTION

The present invention generally relates to trencher machines and, more particularly, to a boom assembly construction for a trencher machine.

BACKGROUND OF THE INVENTION

A typical trenching machine includes a boom assembly mounted on and extending from a frame of the trencher machine. The boom assembly is mounted for movement between a transport position and a digging position. The boom assembly includes an endless digging chain and tooth assembly which orbitally rotates during operation of the machine to dig a relatively narrow trench in the ground.

A drive sprocket is typically provided toward a first end of the boom assembly for controlling the operational speed of the digging chain and tooth assembly. The digging chain and tooth assembly is entrained about and rotatably supported by the drive sprocket.

The boom assembly further includes a boom which extends away from the drive sprocket and has the digging chain and tooth assembly arranged for orbital movement thereabout. A boom end idler assembly is normally provided toward a free end of the boom for further supporting the digging chain and tooth assembly. The boom end idler assembly includes a boom end idler having a diameter considerably larger than the drive sprocket to reduce chain roller wear as the chain of the digging chain and tooth assembly rotates thereabout.

Boom assemblies equipped with larger diameter boom end idlers at the free end thereof usually include a boom configured as a hollow housing with laterally spaced side walls arranged on each side of the boom end idler and having top and bottom walls joining the side walls. The top and bottom walls of the boom housing support extended reaches of the digging chain and tooth assembly and inhibit rocks and the like from becoming entrapped between the digging chain and tooth assembly and the boom.

Some trencher manufacturers utilize anti-friction bearings such as roller bearings centrally accommodated within the boom end idler to mount and facilitate free rotation of the boom end idler about the boom. Conventional roller bearings include rolling members between inner and outer races to significantly reduce the rotational and frictional drag of the boom end idler about its rotational axis and thereby reduce the power required to drive the chain and tooth assembly.

To further reduce frictional drag on the boom end idler as it rotates, the lateral space between inner surfaces of the side walls of the boom housing is greater than the width or thickness of the boom end idler. Thus, the boom end idler assembly is substantially free to rotate therebetween. As a result of such construction, however, there is a lateral space or opening between the boom end idler and each of the side walls of the boom housing. As will be appreciated, trencher manufacturers try to minimize the opening or space between the boom end idler and the boom housing.

As the digging chain and tooth operates, there is an abundance of mud, dirt, stones, rocks and other foreign debris circulating about the boom assembly. Such dirt, mud and other foreign debris presents a serious problem to boom assemblies using boom end idlers in that such foreign debris tends to move through the space or opening between the boom end idler and the boom housing and gets into the bearing area and contaminates the bearing. As will be appreciated, the dirt and other debris acts to sometimes seize and/or quickly destroy the bearing thus requiring repair or replacement thereof.

Some anti-friction bearing include seals on opposite sides of the rolling members between the inner and outer races of the bearing. Although adding cost to the bearings, such seals do not prevent dirt, debris and other foreign matter from moving through the openings between the boom end idler and the boom housing and toward the bearing. As a result such seals are quickly destroyed by the contaminants in the working environment. The beneficial results obtained from use of anti-friction bearings is therefore quickly lost due to the down time associated with repair or replacement of the bearings resulting from contamination thereof by the environmental conditions in which the boom assembly is typically operated.

Thus, there is a need and a desire for a trencher boom assembly having a boom end idler which is mounted to a boom by anti-friction bearings which are sealed to the environment in which the boom assembly normally operates.

SUMMARY OF THE INVENTION

In view of the above and in accordance with the present invention, there is provided a boom assembly having an elongated boom adapted to have a digging chain and tooth assembly rotatable thereabout and provided with a bifurcated free end including laterally spaced side walls or members. A boom end idler assembly is arranged between the side walls at the free end of the boom for rotatably supporting the chain and tooth assembly which is entrained thereabout. The boom end idler assembly includes a boom end idler with an anti-friction bearing having inner and outer races and anti-friction rollers therebetween. Seals are disposed between opposite sides of the anti-friction bearing and the side walls of the boom to inhibit dirt and other debris from contaminating the bearing. Clamp means pass through aligned apertures in the side walls of the boom and at least partially within the inner race of the bearing for defining the rotational axis of the boom end idler.

The clamp means exert an inwardly directed force to further reduce lateral spacing between the boom housing and side faces of the boom end idler and furthermore compliment the sealing effectiveness of the seals in maintaining foreign debris away from the bearing. In a preferred form of the invention, the clamp means comprises two generally cylindrically shaped caps arranged in opposed relation to each other. Each of the caps has a stepped configuration. The clamp means further includes adjustable means readily accessible to opposite sides of the boom for variably adjusting the clamping force applied against the sides of the boom housing.

In a most preferred form of the invention, the adjustable means associated with the clamp means includes threaded members for drawing the clamp means caps inwardly toward each other. Moreover, each of the threaded members include a headed portion which is accommodated within a respective cap so as to minimize the width of the boom and inhibit a head portion of each fastener from rubbing on the vertical walls of the trench.

The seals for maintaining foreign debris away from the bearing are fabricated from a non-metallic preferably nylon composition which can include a graphite mixture to enhance the frictionless characteristics of the seals. In a preferred form of the invention, each seal includes at least two annular and generally flat non-metallic rings positioned in layered relation relative to each other between the boom end idler assembly and side walls of the boom to promote movement therebetween. In a most preferred form of the invention, each seal ring is fabricated from a polyurethane material.

The seals provide an effective, simple, and inexpensive means for protecting the bearing of the boom end idler assembly against contamination from dirt, stones and other debris inherent in the environment in which the boom assembly operates. The seals are sized to fit the between the boom and the boom end idler and facilitate use of an anti-friction bearing on the boom end idler assembly. As will be appreciated, use of the anti-friction bearing reduces power consumption and thus prolongs operational times for the chain and tooth assembly. Moreover, the seal rings inhibit contamination of the bearing thus reducing downtime involved with repair and/or replacement of the bearings.

Numerous other features and advantages of the present invention will become readily apparent from the following detailed description, the accompanying drawings, and the appended claims.

DESCRIPTION OF A PREFERRED EMBODIMENT

Figure 1:
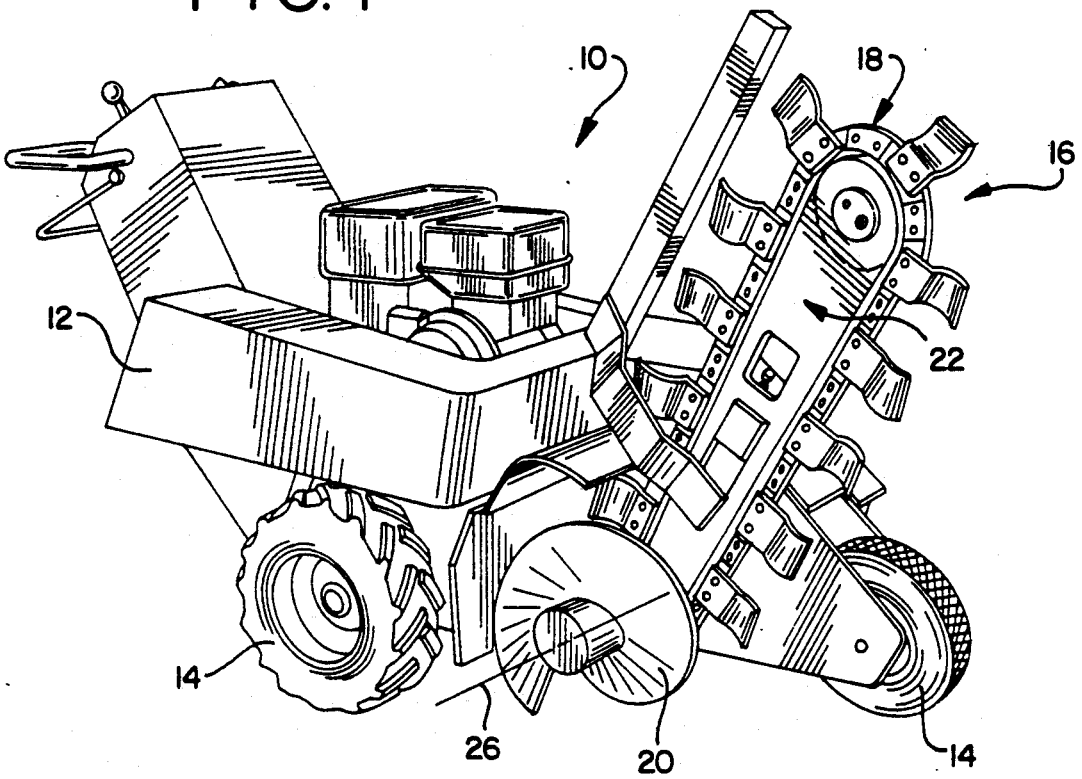
FIG. 1 is a perspective view of a trencher machine having a boom assembly constructed in accordance with the principles of the present invention.
Figure 2:
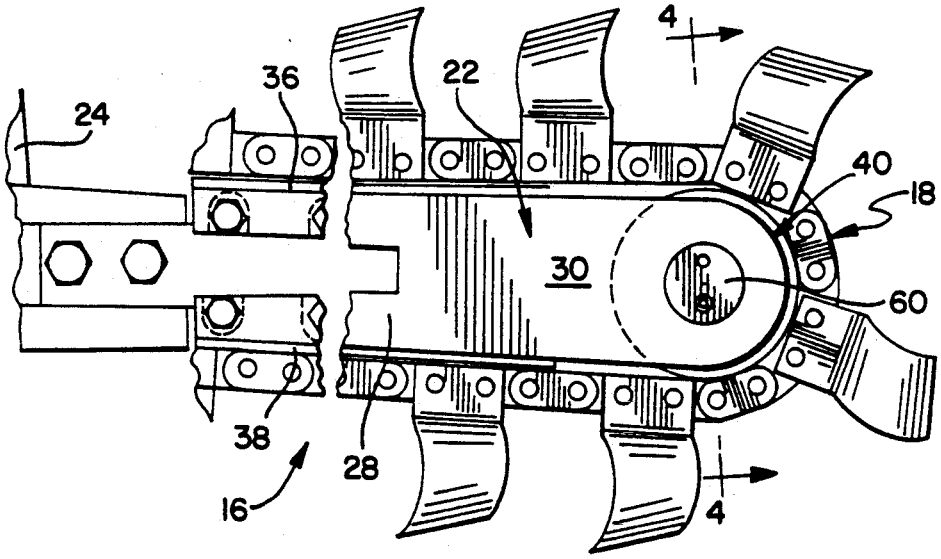
FIG. 2 an enlarged fragmentary view of the boom assembly illustrated in FIG. 1.

While the present invention is susceptible of embodiment in various forms, there is shown in the drawings a presently preferred embodiment hereinafter described, with the understanding that the present disclosure is to be considered as an exemplification of the invention and is not intended to limit the invention to the specific embodiment illustrated.

Referring now to the drawings, wherein like reference numerals refer to like parts throughout the several views, a trenching machine is represented in its entirety by reference numeral 10. Although a portable walk-behind trencher model is illustrated, it should be appreciated that the teachings of the present invention are equally applicable to other types and models of trenching machines. Trencher 10 includes a mobile frame 12 supported for movement across a field by a plurality of ground-engaging wheels or tracks 14. Trencher 10 further includes a boom assembly 16. As is conventional, a digging chain and tooth assembly 18 is mounted to and rotatably supported for orbital movement about the boom assembly for digging in the ground. Further, an auger 20 is provided to disburse to the side of the trench the dirt and soil that is dug during the trenching operation.

Boom assembly 16 includes an elongated boom 22 with the digging chain and tooth assembly 18 rotatable thereabout. At one end, pivot means 24 connects the boom 22 to the frame 12 and allows the boom assembly 16 to move about a generally horizontal axis 26 between transport and digging positions.

Figure 3:
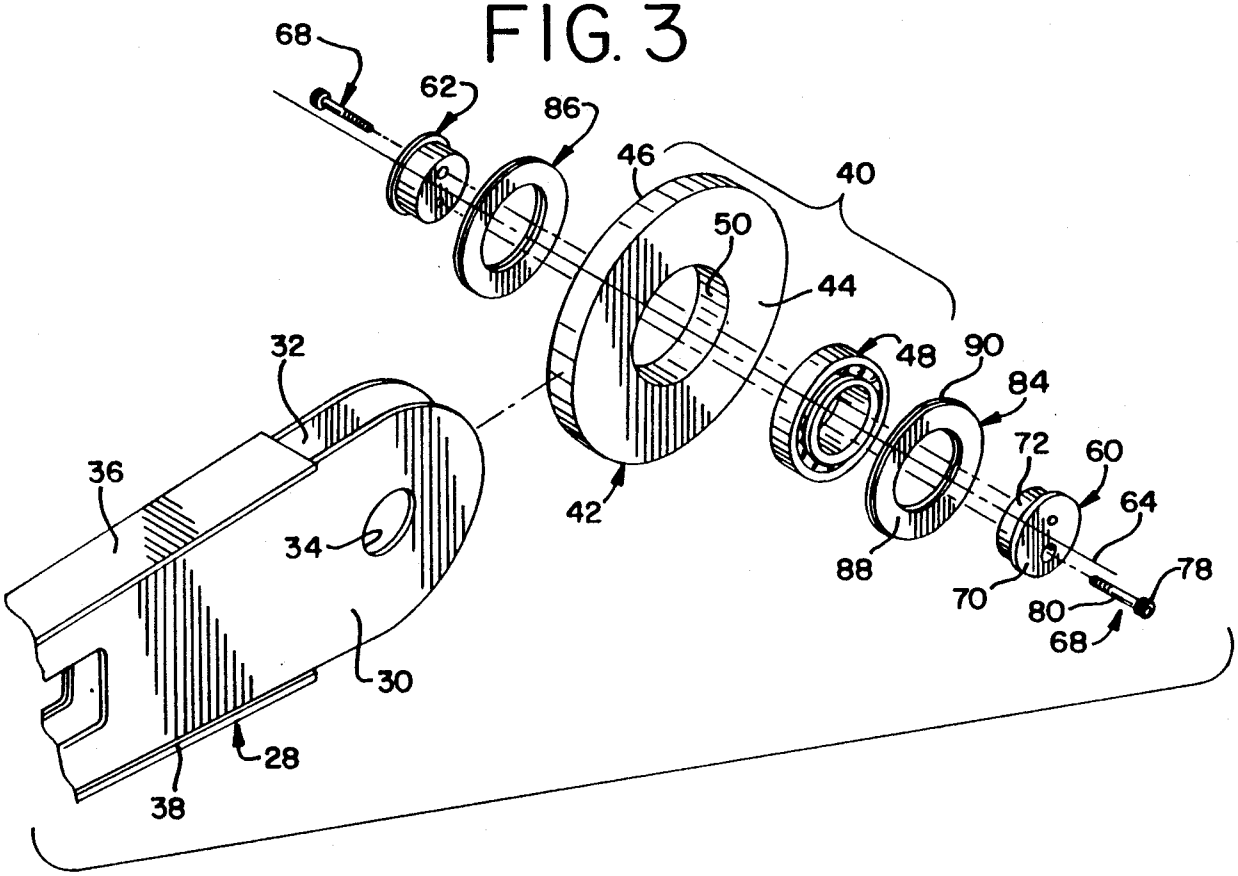
FIG. 3 is a perspective view of a boom end idler as forming part of the boom assembly illustrated in FIGS. 1 and 2.

In a preferred form of the invention, boom 22 includes an elongated rigid housing 28 adjustably and releasably secured to the pivot means 24. As shown in FIG. 3, boom housing 28 has a bifurcated configuration at a free end thereof defined by a pair of side walls 30 and 32 which are laterally spaced apart by a predetermined distance. Each side wall 30, 32 defines axially aligned aperture 34, 35, respectively, toward a free or forward end thereof. Moreover, side walls 30, 32 are joined by top and bottom walls 36 and 38 which are disposed between and movably support extended reaches of the endless digging chain and tooth assembly 18. Notably, the free ends of side walls 30, 32 extend in a cantilevered fashion beyond the terminal ends of top and bottom walls 36, 38.

Boom assembly 16 further includes a boom end idler assembly 40 arranged toward the second end of the boom housing 28 between the side walls 30, 32. Boom end idler assembly 40 rotatably supports the digging chain and tooth assembly 18 which is entrained thereabout and includes a boom end idler 42 having opposite generally planar lateral faces 44 and 46 and a bearing assembly 48. A central bore 50 in the boom end idler 42 fixedly accommodates the bearing assembly 48.

Figure 4:
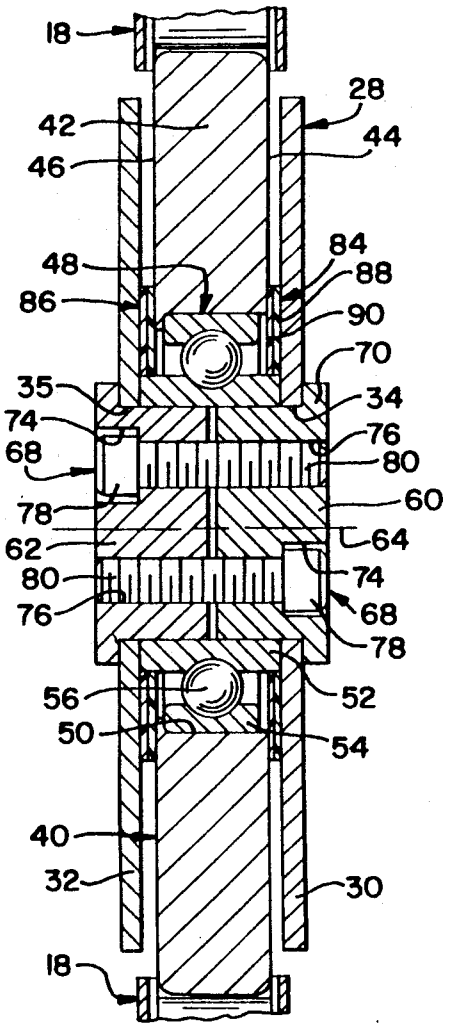
FIG. 4 is a sectional view taken along line 4—4 of FIG. 2.

To promote free rotation of boom end idler 42 with minimal frictional drag and lateral distortion, bearing assembly 48 is configured as an anti-friction bearing assembly. Bearing assembly 48 includes inner and outer races 52 and 54, respectively with a plurality of spherical members or balls 56 captively maintained therebetween. As shown in FIG. 4, the inner race 52 of bearing assembly has a width substantially equal to the lateral distance separating the side walls 30, 32 of boom housing 28.

A pair of axially aligned members 60 and 62 extend inwardly through the apertures 34, 35 in the side walls 30, 32 of the boom housing 28 and at least partially extend axially within the inner race 52 of bearing assembly 48 to define a rotational axis 64 about which the boom end idler assembly 40 turns. As will explained hereinafter, members 60 and 62 are fastened to each other through use of identical threaded fasteners 68.

In the illustrated embodiment, members 60, 62 are substantially identical. Thus, only the structure of member 60 will be discussed in detail with the understanding that member 62 is similarly constructed. In the illustrated embodiment, member 60 has a stepped generally cylindrical configuration. That is, member 60 has a first portion 70 that has a configuration larger than the diameter of aperture 34 and a smaller second portion 72 having a cylindrical configuration generally corresponding to the inside diameter of the inner race 52 of bearing 48. As shown, a free end of the second portion 72 of each member 60, 62 axially extends within the inner race 52 of bearing 48 for approximately half the width of the inner race 52. Moreover, each member 60, 62 is provided with a counterbore 74 and a threaded bore 76 arranged in diametrically opposed relation relative to each other and extending generally parallel to the rotational axis 64 of the respective member. As will be appreciated, the counterbores 74 and threaded bores 76 on members 60 and 62 are rotated 180° relative to each other when assembled to the boom.

As shown in FIG. 4, each fastener 68 is provided with an enlarged head portion 78 joined to a threaded portion 80. The headed portion 78 of each fastener is accommodated within the counterbore 74 of a respective member 60, 62 while the threaded portion 80 passes therethrough and engages with the threaded bore 76 of the member arranged in opposed relation to the head portion 78 of the fastener.

A salient feature of the present invention relates to a pair of seals 84 and 86 disposed between opposite sides of the bearing 48 and the side walls 30, 32 of the boom housing 28. During operation of the boom assembly 16, seals 84 and 86 inhibit mud, dirt, stones, rocks, and other debris passing between walls 30 and 32 of boom housing and the boom end idler 42 from contaminating the bearing assembly 48.

Seals 84 and 86 are substantially similar in construction and therefore only seal 84 will be discussed in detail with the understanding that seal 86 is of substantially similar construction. In the illustrated embodiment, each seal is comprised of two annular generally flat rings 88 and 90 arranged in layered relation relative to each other. Each ring 88, 90 is fabricated from a non-metallic nylon material which can be impregnated with a graphite composition to enhance the frictionless characteristics of the seals. Preferably, each ring is fabricated from a 95 durometer polyurethane material.

As shown in FIG. 4, the seals 84 and 86 have an inside diameter which is slightly greater than the outside diameter of the inner race 52 of bearing assembly 48. When installed in combination with the boom end idler assembly 40, the outside diameter of the seals 84, 86 is greater or larger than the diameter of bore 50. This configuration of the seals 84, 86 establishes an interference fit between the side walls 30, 32 of the boom housing 28 and the side faces 44, 46, respectively, of boom end idler 42.

During assembly of the boom assembly 16, the fasteners 68 are sufficiently torqued to draw members 60, 62 inwardly toward each other until the side walls 30, 32 of boom housing 28 engage the inner race 52 of bearing assembly 48. As will be appreciated, drawing the sidewalls 30, 32 laterally inward minimizes the lateral opening or space on opposite sides of the boom end idler relative to the boom housing 28.

The seals 84,86 entrapped between the side walls 30,32 of the boom housing 28 and the lateral faces 44,46, respectively, of the boom end idler 42 provide a closure to any remaining opening or space on lateral sides of the boom end idler 42 and inhibit foreign matter from reaching the bearing assembly 48.

As will be appreciated, the thickness of each seal 84,86 may be greater than the lateral distance separating the respective lateral face of the boom end idler 42 and the adjacent inner surface of the boom housing 28. Fabricating the seals 84,86 from at least two layered rings 88, 90 provides a substantially frictionless surface between the rings 88,90 to facilitate rotation of the boom end idler 42 relative to the boom housing 28. Moreover, fabricating the seals 84,86 from a nylon-like material allows the seals to size themselves in response to rotation of the boom end idler 42 thus forming a close seal about the bearing assembly 48 thereby maintaining foreign debris away therefrom.

Notably, the headed portion 78 of each fastener 68 used to develop the inwardly directed clamping force is accommodated within the counterbore 74 of a respective member 60, 62. Thus, each member 60, 62 extends a minimum lateral distance away from the outer planar surface of the respective side wall 30, 32 on the boom housing and protects the fasteners 68 from rubbing on the walls of the trench being dug by the digging chain assembly 18.

While the present invention is susceptible of embodiment in various forms, there is shown in the drawings a presently preferred embodiment hereinafter described, with the understanding that the present disclosure is to be considered as an exemplification of the invention and is not intended to limit the invention to the specific embodiment illustrated.

What is claimed is:

1. A boom assembly for a trencher having a digging chain and tooth assembly entrained at one end about a chain drive sprocket, said boom assembly comprising:

an elongated boom having a first end connected to said trencher for vertical movement about a generally horizontal axis, said boom having a bifurcated second end defining first and second apertured side walls;

a boom end idler assembly rotatably arranged toward the second end of said boom between said side walls and about which the chain and tooth assembly is entrained, said boom end idler assembly including a boom end idler with an anti-friction bearing centrally accommodated therewithin, said bearing having inner and outer races with anti-friction rolling members entrapped therebetween;

seals disposed between opposite sides of said bearing and said side walls of said boom for inhibiting debris from contaminating said bearing means; and a clamp mechanism having an outer periphery contained within an outer periphery of said side walls and passing inwardly through the apertures in said side walls from opposite sides and at least partially within the inner race of said bearing for defining the rotational axis of said boom end idler assembly said clamp mechanism exerting an inwardly directed clamping force against the side walls of the boom to urge them toward each other thereby minimizing clearances between the boom end idler assembly and the inner surfaces of the side walls of the boom.

2. The boom assembly according to claim 1 wherein said seals are comprised of a non-metallic nylon composition.

3. The boom assembly according to claim 1 wherein said clamp mechanism comprises two generally cylindrically shaped members arranged in opposed relation relative to each other, with each member having a stepped configuration.

4. A boom assembly for a trencher having a digging chain and tooth assembly entrained at one end about a chain drive sprocket, said boom assembly comprising:

an elongated boom having a first end connected to said trencher for vertical movement about a generally horizontal axis, said boom having a bifurcated second end defining first and second apertured side walls;

a boom end idler assembly rotatably arranged toward the second end of said boom between said side walls and about which the chain and tooth assembly is entrained, said boom end idler assembly including a boom end idler with an anti-friction bearing centrally accommodated therewithin, said bearing having inner and outer races with anti-friction rolling members entrapped therebetween;

seals disposed between opposite sides of said bearing and said side walls of said boom for inhibiting debris from contaminating said bearing means; and a clamp mechanism having an outer periphery contained within an outer periphery of said side walls and passing through the apertures in said side members and at least partially within the inner race of said bearing means for defining the rotational axis of said boom end idler assembly said clamp mechanism clamping the side walls of the boom to each other to minimize clearances between the boom end idler assembly and the inner surfaces of the side walls of the boom, and wherein said clamp mechanism includes adjustable members readily accessible from opposite sides of said boom for variably adjusting the clamping force applied against the side members of the boom.

5. A trencher boom assembly adapted to have an endless digging chain with digging elements rotatable thereabout, said boom assembly comprising:

a boom with rear pivot means for allowing said boom to vertically move about a generally horizontal axis between transport and digging positions, said boom including an elongated rigid housing having a rear end adapted for releasible securement to said pivot means and a forward end, said housing having a pair of side walls laterally spaced apart by a predetermined distance, each of said side walls defining an aperture toward a forward end of the side wall and with the apertures in said side walls being axially aligned relative to each other, said side walls being joined by top and bottom walls disposed between extended reaches of the endless chain;

a boom end idler disposed between the side walls of said boom housing toward the forward end thereof, said boom end idler supporting the digging chain for movement about a fixed forward axis;

bearing means accommodated within a central bore defined by said boom end idler, said bearing means including inner and outer races with a plurality of rolling members captively maintained therebetween;

a pair of axially aligned members inwardly extending through the side walls of said boom housing in opposite directions toward each other and at least partially within the inner race of said bearing means for defining a fixed axis for said boom end idler, said axially aligned members exerting a clamping force which maintains minimum clearances between said side walls on the boom and the boom end idler; and seal means disposed between opposite sides of said bearing means and said side walls of said boom housing for closing the clearances between the side walls of the boom and the boom end idler thereby inhibiting dirt and other debris from contaminating said bearing means.

6. The boom assembly according to claim 5 wherein said seal means comprises two annular generally flat non-metallic rings in layered relation relative to each other on each side of said ball bearing means.

7. The boom assembly according to claim 6 wherein each of said rings is fabricated from a polyurethane composition.

8. The boom assembly according to claim 5 wherein each of said members applying a clamping force includes threaded fasteners for drawing said members inwardly toward each other.

9. The boom assembly according to claim 8 wherein each of the threaded fasteners include a headed portion which is accommodated within a counterbore defined by a respective member applying a clamping force to minimize the effective width of the boom assembly.

10. A trencher boom assembly adapted to have a digging chain and tooth assembly rotatable thereabout, said boom assembly comprising:

a boom including a walled housing having rear and forward ends, said housing including a pair of side walls laterally spaced apart by a predetermined distance and joined by top and bottom walls extending for a portion of the length of the side walls and terminating short of the forward end of said housing;

a boom end idler assembly rotatably mounted toward the forward end of the boom between said side walls and about which the chain and tooth assembly is entrained, said boom end idler assembly including a boom end idler supported for rotation by a bearing, said boom end idler having a thickness which is less than the predetermined distance between said side walls of the boom housing such that clearances are provided between the boom end idler and the boom housing to facilitate free rotation of the boom end idler assembly relative to the boom housing, and with said bearing means including end faces which project beyond opposite sides of the boom end idler and against the side walls of the housing;

a pair of substantially identical clamp members passing inwardly through and from opposite sides of said side walls and for drawing the side walls of the boom housing toward each other and into abutting relation with the end faces of the bearing to minimize the clearances between the boom end idler assembly and the side walls of the boom housing thereby inhibiting contamination of the bearing from foreign matter passing through the clearances on opposite sides of the boom end idler assembly.

11. The trencher boom assembly according to claim 10 further including seals circumferentially surrounding the bearing and arranged in the clearances on opposite sides of the boom end idler assembly for inhibiting contamination of said bearing.

12. A trencher boom assembly adapted to have a digging chain and tooth assembly rotatable thereabout, said boom assembly comprising:

a boom including a walled housing having rear and forward ends, said housing including a pair of laterally spaced side walls joined by top and bottom walls, said top and bottom walls terminating short of the forward end of the boom housing;

a boom end idler assembly rotatably mounted toward the forward end of the boom between said side walls and about which the chain and tooth assembly is entrained, said boom end idler assembly including a boom end idler having an anti-friction bearing assembly journalled by boom end idler support means carried by said boom, said anti-friction bearing assembly including inner and outer races with a series of roller means captively maintained therebetween; and seal assemblies disposed between opposite sides of said bearing means and said side walls of the boom housing for inhibiting foreign debris from contaminating said bearing means, each seal assembly including a pair of non-metallic seal rings arranged in movable and layered relation relative to each other to facilitate rotation of the boom end idler relative to the boom housing, each of said rings having an inside diameter fitting about said boom end idler support means and an outside diameter which is greater than the outside diameter of the outer race of said bearing assembly.

* * * * *